US008431312B2

(12) United States Patent
Masuda et al.

(10) Patent No.: US 8,431,312 B2
(45) Date of Patent: Apr. 30, 2013

(54) CARRIER, DEVELOPER, AND IMAGE FORMING METHOD

(75) Inventors: Minoru Masuda, Shizuoka (JP); Kimitoshi Yamaguchi, Shizuoka (JP); Yutaka Takahashi, Shizuoka (JP); Koichi Sakata, Shizuoka (JP); Hitoshi Iwatsuki, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 52 days.

(21) Appl. No.: 13/128,241

(22) PCT Filed: Nov. 10, 2009

(86) PCT No.: PCT/JP2009/069414

§ 371 (c)(1), (2), (4) Date: May 9, 2011

(87) PCT Pub. No.: WO2010/055933

PCT Pub. Date: May 20, 2010

(65) Prior Publication Data

US 2011/0217649 A1 Sep. 8, 2011

(30) Foreign Application Priority Data

Nov. 12, 2008 (JP) ..... 2008-290202

(51) Int. Cl.
*G03G 9/00* (2006.01)

(52) U.S. Cl.
USPC ..... 430/111.35; 430/111.1; 430/111.31; 430/111.32

(58) Field of Classification Search ..... 430/111.1, 430/111.31, 111.32, 111.35
See application file for complete search history.

(56) References Cited

U.S. PATENT DOCUMENTS

| | | | | |
|---|---|---|---|---|
| 4,460,739 | A | 7/1984 | Ashby | |
| 4,672,016 | A | 6/1987 | Isoda et al. | |
| 6,040,101 | A * | 3/2000 | Naka et al. | 430/111.1 |
| 6,054,243 | A | 4/2000 | Yamane et al. | |
| 6,106,987 | A * | 8/2000 | Hakata et al. | 430/111.35 |
| 6,562,537 | B1 | 5/2003 | Mukataka et al. | |
| 6,828,075 | B2 | 12/2004 | Suzuki et al. | |
| 7,381,513 | B2 | 6/2008 | Suzuki et al. | |
| 7,399,568 | B2 * | 7/2008 | Fukui et al. | 430/111.35 |

(Continued)

FOREIGN PATENT DOCUMENTS

| | | |
|---|---|---|
| CN | 1550918 A | 12/2004 |
| CN | 1690869 A | 11/2005 |

(Continued)

OTHER PUBLICATIONS

International Search Report issued Dec. 8, 2009 in PCT/JP09/069414 filed Nov. 10, 2009.

(Continued)

*Primary Examiner* — Stewart Fraser
(74) *Attorney, Agent, or Firm* — Oblon, Spivak, McClelland, Maier & Neustadt, L.L.P.

(57) ABSTRACT

The present invention provides a carrier which includes core material particles, and a coating layer on surfaces of the core material particles, wherein the coating layer contains a crosslinked product which is obtained by condensation of a silicone resin with an organic zirconium catalyst, the silicone resin having at least one of a silanol group and a functional group capable of generating a silanol group by means of hydrolysis.

13 Claims, 1 Drawing Sheet

U.S. PATENT DOCUMENTS

| | | | | |
|---|---|---|---|---|
| 7,468,233 | B2 | 12/2008 | Nagayama et al. | |
| 7,527,908 | B2 | 5/2009 | Iwatsuki et al. | |
| 7,553,598 | B2 | 6/2009 | Suzuki et al. | |
| 7,592,116 | B2 | 9/2009 | Suzuki et al. | |
| 2006/0051695 | A1* | 3/2006 | Yuasa et al. | 430/111.35 |
| 2006/0210905 | A1 | 9/2006 | Imahashi et al. | |
| 2006/0269863 | A1 | 11/2006 | Nakamura et al. | |
| 2007/0048652 | A1 | 3/2007 | Imahashi et al. | |
| 2007/0243482 | A1 | 10/2007 | Yamaguchi et al. | |
| 2008/0063969 | A1 | 3/2008 | Yamaguchi et al. | |
| 2008/0073252 | A1 | 3/2008 | Yamaguchi et al. | |
| 2008/0213684 | A1 | 9/2008 | Nagayama et al. | |
| 2008/0227004 | A1 | 9/2008 | Yamaguchi et al. | |
| 2009/0041510 | A1 | 2/2009 | Imahashi et al. | |
| 2009/0074450 | A1 | 3/2009 | Nagayama et al. | |
| 2009/0092920 | A1 | 4/2009 | Nagayama et al. | |
| 2010/0233613 | A1 | 9/2010 | Masuda et al. | |
| 2010/0239975 | A1 | 9/2010 | Yamaguchi et al. | |
| 2011/0065037 | A1 | 3/2011 | Iwatsuki et al. | |

FOREIGN PATENT DOCUMENTS

| | | |
|---|---|---|
| JP | 60 49077 | 3/1985 |
| JP | 5 197214 | 8/1993 |
| JP | 6 222621 | 8/1994 |
| JP | 11 133672 | 5/1999 |
| JP | 2001 92189 | 4/2001 |
| JP | 2001 188387 | 7/2001 |
| JP | 2002 207323 | 7/2002 |
| JP | 2002 207324 | 7/2002 |
| JP | 2006 330277 | 12/2006 |
| JP | 2006 335854 | 12/2006 |
| JP | 2006 337828 | 12/2006 |
| JP | 3933498 | 3/2007 |
| JP | 2008 165061 | 7/2008 |
| JP | 2008 268583 | 11/2008 |

OTHER PUBLICATIONS

Office Action issued Jul. 30, 2012, in Chinese Patent Application No. 200980154299.3 with English translation.

* cited by examiner

CARRIER, DEVELOPER, AND IMAGE FORMING METHOD

CROSS-REFERENCE TO RELATED APPLICATIONS

This application is a National Stage of PCT/JP2009/069414 filed Nov. 10, 2009 and claims the benefit of JP 2008-290202 filed Nov. 12, 2008.

TECHNICAL FIELD

The present invention relates to a carrier having a coating layer formed on surfaces of core material particles, and also relates to a developer and an image forming method.

BACKGROUND ART

In image formation based on an electrophotographic process, a latent electrostatic image is formed on a latent electrostatic image bearing member containing a photoconductive material or the like, a charged toner is made adhere onto the latent electrostatic image to form a toner image, and then the toner image is transferred onto a recording medium, and fixed on the recording medium to be an output image. In recent years, there have been rapid developments from monochrome image technologies toward full color image technologies of copiers and printers using electrophotographic processes, and the market of full color image technologies increasingly tends to expand.

Typically, in color image formation based on a full color electrophotographic process, all colors are reproduced by superimposing three primary color toners of yellow, magenta, and cyan or four color toners with black color toner added to the three primary colors. Therefore, to obtain a full color image having excellence in color-reproducibility and color vividness, the surface of the fixed toner image must be smoothed and evened to some extent to reduce scattering of light. For this reason, there were so many conventional types of full color copiers to or the like which have a middle level of image glossiness to high level image glossiness of 10% to 50%.

Typically, as a method of fixing a dry toner image on a recording medium, a contact-heating fixing method is heavily used in which a roller or belt having a smooth surface is heated and the surface is press-contacted with a toner. Such a fixing method achieves high thermal efficiency, enables high-speed fixation, and enables imparting glossiness and transparency to color toners, but on the other hand, a so-called "offset phenomenon" is liable to take place in which a part of toner image is attached to a surface of a fixing roller and then transferred onto another image, because it is necessary that the surface of a heat-fixing member be brought in contact with a toner in a molten state under application of pressure and then be separated from the heat-fixing member.

For the purpose of preventing the offset phenomenon, a method is typically employed in which the surface of a fixing roller is formed of a silicone rubber, a fluororesin or the like, and further, an oil for preventing adhesion of toner, such as a silicone oil, is applied on the surface of the fixing roller. This method is extremely effective in preventing toner offset, however, it requires a device for supplying the oil, and has a problem that the fixing unit becomes large in size.

For this reason, in monochrome image formation, there is a tendency to employ an oil-less system where no oil is applied to a fixing roller or a system that requires only a small amount of oil applied to a fixing roller, by using a toner which has high viscoelasticity in the molten state and contains a releasing agent so that the molten toner does not internally fracture.

Meanwhile, also in full color image formation, similarly to monochrome image formation, there is a tendency to employ oil-less systems for the purpose of achieving downsizing and structural simplification of fixing devices. In full color image formation, in order to smooth the surface of a fixed toner image, it is however necessary to reduce the viscoelasticity of toner in the molten state, and thus an offset phenomenon is more likely to occur than formation of monochrome images which have no glossiness, making it difficult to employ oil-less systems. When a toner containing a releasing agent is used, the transferability of the toner onto a recording medium degrades due to increased adhesiveness of the toner. Further, toner filming occurs, and the chargeability of the toner degrades, causing a degradation of the durability.

In the meanwhile, as a carrier, there has been known a carrier whose surface is coated with a silicone resin, for the purpose of preventing toner filming, forming a surface with a uniform thickness, preventing oxidation of the surface as well as a reduction in moisture sensitivity, prolonging the life of developers, preventing adhesion of toner onto a photoconductor, protecting the photoconductor from scratches and abrasion, controlling the charge polarity, and adjusting the charge amount.

For example, Patent Literature 1 discloses a carrier in which surface of core material particles are coated around with a silicone resin containing an organic titanium catalyst.

Patent Literature 2 discloses a carrier in which surfaces of core material particles are coated with a coating agent containing, as main components, organopolysiloxane, organosilane, and a coatable composition which is composed of a curing catalyst containing at least one selected from the group consisting of titanium, tin, zinc, cobalt, iron, an aluminum compound, and amines.

Further, Patent Literature 3 discloses a carrier in which surfaces of core material particles are coated with a quaternary aluminum catalyst, a silicone resin containing to a titanium catalyst or a modified silicone resin.

However, the techniques disclosed in the prior art cause problems with blocking and a degradation of durability of the carrier.

[Citation List]

[Patent Literature]

[PTL 1] Japanese Patent Application Laid-Open (JP-A) No. 2001-92189

[PTL 2] Japanese Patent Application Laid-Open (JP-A) No. 06-222621

[PTL 3] Japanese Patent Application Laid-Open (JP-A) No. 2006-337828

SUMMARY OF INVENTION

The present invention aims to provide a carrier which is capable of preventing blocking that could occur when a coating layer is formed on a carrier core material and which is excellent in durability; a developer containing the carrier; and an image forming method using the developer.

Means for solving the problems in the related art are as follows:

<1> A carrier including:

core material particles, and a coating layer on surfaces of the core material particles, wherein the coating layer contains a crosslinked product which is obtained by condensation of a silicone resin with an organic zirconium catalyst, the silicone resin having at least one of a silanol group and a functional group capable of generating a silanol group by means of hydrolysis.

<2> The carrier according to <1>, wherein the organic zirconium catalyst is a zirconium chelate.

<3> The carrier according to one of <1> and <2>, wherein the amount of the organic zirconium catalyst is 0.5 parts by mass to 20 parts by mass per 100 parts by mass of the silicone resin.

<4> The carrier according to any one of <1> to <3>, wherein the organic zirconium catalyst is zirconium tetraacetylacetonate.

<5> The carrier according to any one of <1> to <4>, wherein the coating layer further contains conductive particles.

<6> The carrier according to any one of <1> to <5>, wherein the coating layer further contains a silane coupling agent.

<7> The carrier according to any one of <1> to <6>, wherein the coating layer further contains an acrylic resin.

<8> The carrier according to any one of <1> to <7>, wherein the carrier has a volume resistivity of $1\times10^{9}$ Ω·cm to $1\times10^{17}$ Ω·cm.

<9> The carrier according to any one of <1> to <8>, wherein n the coating layer has an average thickness of 0.05 μm to 4 μm.

<10> The carrier according to any one of <1> to <9>, wherein the core material particles have a weight average particle diameter of 20 μm to 65 μm.

<11> The carrier according to any one of <1> to <10>, wherein the carrier has a magnetization of 40 $Am^2$/kg to 90 $Am^2$/kg in a magnetic field of 1 kOe.

<12> A developer including:

the carrier according to any one of <1> to <11>, and a toner.

<13> The developer according to <12>, wherein the toner is a color toner.

<14> An image forming method including:

forming a latent electrostatic image on a surface of a latent electrostatic image bearing member, developing the latent electrostatic image using the developer according to one of <12> and <13> to form a visible image, transferring the visible image onto a recording medium, and fixing the transferred image on the recording medium.

<15> A process cartridge including:

a latent electrostatic image bearing member, and a developing unit configured to develop a latent electrostatic image formed on a surface of the latent electrostatic image bearing member using the developer according to one of <12> and <13> to form a visible image.

<16> A supplemental developer including:

the carrier according to any one of <1> to <11>, and a toner in an amount of 2 parts by mass to 50 parts by mass being mixed with 1 part by mass of the carrier.

According to the present invention, it is possible to provide a carrier which is capable of preventing blocking that could occur when a coating layer is formed on a carrier core material and which is excellent in durability; a developer containing the carrier; and an image forming method using the developer.

DESCRIPTION OF EMBODIMENTS (Carrier)

Figure 1:
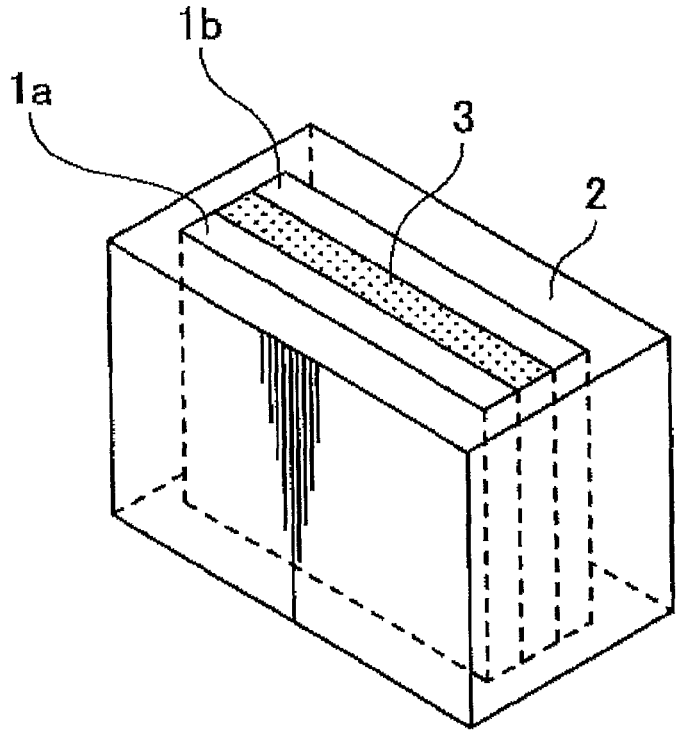
FIG. 1 is a diagram showing a cell for use in measuring a volume resistivity of a carrier.

A carrier according to the present invention contains core material particles and a coating layer on surfaces of the core material particles and further contains other layers as required.

<Coating Layer>

The coating layer contains a crosslinked product which is obtained by condensation of a silicone resin having a silanol group and/or a functional group capable of generating a silanol group by means of hydrolysis (which is hereinafter referred to as "hydrolyzable functional group"), with use of an organic zirconium catalyst. With this, it is possible to sufficiently accelerate a condensation reaction of the silanol group. As a result, it is possible to prevent blocking when a coating layer is formed.

Also, it is possible to form a coating layer which is excellent in adhesiveness with respect to core material particles, and which has small surface energy and small adherence. As a result, it is possible to prevent toner filming. Further, by condensing the silanol group, a siloxane bond is generated to increase the molecular weight of the silicone resin, and therefore the strength of the coating layer can be increased. On this occasion, by increasing the number of silanol groups and hydrolyzable functional groups per silicon atom in the silicone resin, the crosslink density of the silicone resin is increased, thereby making it possible to improve the hardness of the coating layer.

The silicone resin is not particularly limited as long as it has a silanol group and/or a hydrolyzable functional group. Two or more silicone resins may be used in combination.

The hydrolyzable functional group is not particularly limited and may be suitably selected in accordance with the intended use. Examples thereof include, but are not limited to, a halosilyl group, an alkoxysilyl group, a hydrosilyl group, and an isocyanate silyl group. These may be used alone or in combination.

Commercially available products of the silicone resin having a silanol group and/or a hydrolyzable group are not particularly limited, and there may be exemplified KR155, KR282, KR211, KR216, and KR213 (produced by Shin-Etsu silicone Corp.); and AY42-170, SR2510, SR2406, SR2410, SR2405, and SR2411 (produced by TORAY Silicone Co., Ltd.).

The organic zirconium catalyst is not particularly limited and may be suitably selected in accordance with the intended use. Examples thereof include, but are not limited to, zirconium alkoxides such as zirconium tetra-n-propoxide, and zirconium tetra-n-butoxide; zirconium chelates such as zirconium tetraacetylacetonate, zirconium tributoxy monoacetylacetonate, zirconium monobutoxy acetylacetonate bis(ethylacetoacetate), and zirconium dibutoxy bis(ethylacetoacetate); and zirconium acylates such as zirconium tributoxy monostearate. These may be used alone or in combination. Among these, particularly preferred are zirconium chelates for their effect of accelerating a condensation reaction of a silanol group. Further, among zirconium chelates, zirconium tetraacetylacetonate is particularly preferable.

Zirconium alkoxides, zirconium chelates, zirconium acylates and the like for use in the present invention act as catalysts with respect to silicone resins having a silanol group and/or a hydrolyzable functional group and also act as monomers. When catalysts act as monomers, they are incorporated into silicone resins. For this reason, when a catalyst that does not act ac a monomer is used, the amount of use thereof can be increased. When a catalyst that does not act as a monomer is used with a silicone resin, it remains separately as a catalyst in the silicone resin, and thus the amount of use of the catalyst is increased, a large amount of the catalyst remains in the silicone resin, causing a problem. An increase in stickiness and in surface energy of the resulting carrier take place, and carrier spent frequently occurs. Meanwhile, since the zirconium alkoxides, zirconium chelates, zirconium acylates and the like for use in the present invention are incorporated into silicone resins, the above-mentioned problems do not occur even when the amount of use thereof is increased.

In the present invention, it is preferable to use the organic zirconium catalyst in an amount of 0.5 parts by mass to 20 parts by mass relative to 100 parts by mass of the silicone resin having a silanol group and/or a hydrolyzable functional group. The use of 20 parts by mass of the catalyst relative to 100 parts by mass of the silicone resin seems to be excessive, however, because the organic zirconium catalyst acts as a monomer and is incorporated into the silicone resin, no problem occurs. Further, it is more preferable to use 2 parts by mass to 15 parts by mass of the organic zirconium catalyst relative to 100 parts by mass of the silicone resin having a silanol group and/or a hydrolyzable functional group. When the amount of the organic zirconium catalyst used is less than 0.5 parts by mass, a condensation reaction does not proceed due to the small amount of the organic zirconium catalyst used, causing a problem in the course, of coating treatment and calcination. When the amount of the organic zirconium catalyst used is more than 20 parts by mass, the amount of the organic zirconium catalyst which is not incorporated into the silicone resin increases, also causing a problem. As a result, a large amount of a titanium compound having a small molecular weight remains in the resulting carrier, and there is a concern of increasing the stickiness and the surface energy of the carrier and of a reduction in strength of the coating layer.

It should be noted that the coating layer can be formed by using a coating layer composition containing a silicone resin having a silanol group and/or hydrolyzable functional group, an organic zirconium catalyst, and a solvent, and as required, a resin other than the silicone resin having a silanol group and/or hydrolyzable functional group. More specifically, the coating layer may be formed by condensing a silanol group while coating surfaces of core material particles with the coating layer composition, or may be formed by coating surfaces of core material particles with the coating layer composition before condensing the silanol group. The method of condensing a silanol group while coating surfaces of core material particles with the coating layer composition is not particularly limited, and for example, there may be exemplified a method in which surfaces of core material particles are coated with the coating layer composition under application of heat, light or the like. The method of coating surfaces of core material particles with the coating layer composition before condensing the silanol group is not particularly limited, and for example, there may be exemplified a method in which surfaces of core material particles are coated with the coating layer composition and then heating the core material particles.

The resin other than the silicone resin having a silanol group and/or hydrolyzable functional group is not particularly limited and may be suitably selected in accordance with the intended use. Examples of the resin include, but are not limited to, an acrylic resin, an amino resin, a polyvinyl resin, a polystyrene resin, a halogenated olefin resin, a polyester resin, a polycarbonate resin, a polyethylene resin, a polyvinyl fluoride resin, a polyvinylidene fluoride resin, a polytrifluoroethylene resin, a polyhexafluoropropylene resin, a copolymer of vinylidene fluoride and vinyl fluoride, a fluoroterpolymer such as a terpolymer of tetrafluoroethylene, vinylidene fluoride and a non-fluorine monomer, a silicone resin having no silanol group or hydrolyzable functional group. These may be used alone or in combination. Among these, acrylic resins are particularly preferred for their strong adhesion to core material particles and conductive particles and low brittleness.

The acrylic resin preferably has a glass transition temperature within the range of 20° C. to 100° C., and more preferably within the range of 25° C. to 80° C. Such an acrylic resin has a moderate elasticity, and therefore, when abrasion between a toner and a carrier or abrasion of the carrier particles against each other has a strong impact on the coating layer at the point of frictionally charging the developer, it can absorb the impact and maintain the coating layer without fracture.

More preferably, the coating layer contains a crosslinked product obtained from an acrylic resin and an amino resin. With this, it is possible to prevent fusion of coating layers to each other while maintaining moderate elasticity.

The amino resin is not particularly limited, but a melamine resin and a benzoguanamine resin are preferred for their capability of improving the charge-imparting capability of the resulting carrier. When it is necessary to moderately control the charge-imparting capability of the resulting carrier, another amino resin is optionally used in combination with the melamine resin and/or benzoguanamine resin.

As an acrylic resin crosslinkable with an amino resin, preferred is an acrylic resin having a hydroxyl group and/or a carboxyl group, and more preferred is an acrylic resin having a hydroxyl group. With use of the acrylic resin, it is possible to further improve the adhesion of the coating layer to the core material particles and conductive particles as well as the dispersion stability of the conductive particles. In this case, the acrylic resin preferably has a hydroxyl value of 10 mgKOH/g or more, more preferably 20 mgKOH/g or more.

In the present invention, the coating layer composition preferably contains conductive particles. With this, it is possible to adjust the volume resistivity of the resulting carrier. The conductive particles are not particularly limited and may be suitably selected in accordance with the intended use. Examples thereof include, but are not limited to, carbon black, ITO, a tin oxide, and a zinc oxide. These may be used alone or in combination.

The additive amount of the conductive particles is preferably 0.1 parts by mass to 1,000 parts by mass relative to 100 parts by mass of the silicone resin. When the additive amount of the conductive particles is less than 0.1 parts by mass, the effect of controlling the volume resistivity of the carrier may become insufficient. When it is more than 1,000 parts by mass, it becomes difficult to sufficiently keep possession of the conductive particles in the coating layer, and the surface layer of the resulting carrier is easily broken.

In the present invention, the coating layer composition preferably contains a silane coupling agent. With this, it is possible to disperse the organic zirconium catalyst and the conductive particle in a stable manner.

The silane coupling agent is not particularly limited and may be suitably selected in accordance with the intended use. Examples thereof include, but are not limited to, r-(2-aminoethyl)aminopropyltrimethoxysilane, r-(2-aminoethyl)aminopropyl-methyldimethoxysilane, r-methacryloxypropyl trimethoxysilane, N-β-(N-vinylbenzylaminoethyl)-r-aminopropyltrimethoxy silane hydrochloride, r-glycydoxypropyl-trimethoxysilane, r-mercaptopropyl-trimethoxysilane, methyltrimethoxysilane, methyltriethoxysilane, vinyltriacetoxysilane, r-chloropropyl-trimethoxysilane, hexamethyldisilazane, r-anilinopropyl-trimethoxysilane, vinyltrimethoxysilane, octadecyldimethyl[3-(trimethoxysilyl)propyl]ammonium chloride, r-chloropropylmethyldimethoxysilane, methyltrichlorosilane, dimethylchlorosilane, trimethylchlorosilane, allyltriethoxysilane, 3-aminopropyl methyldiethoxysilane, 3-aminopropyltrimethoxysilane, dimethyldiethoxysilane, 1,3-divinyltetramethyldisilazane, and methacryloxyethyldimethyl(3-trimethoxysilylpropyl)ammonium chloride. These may be used alone or in combination.

Examples of commercially available products of the silane coupling agent include, but are not limited to, AY43-059, SR6020, SZ6023, SH6026, SZ6032, SZ6050, AY43-310M, SZ6030, SH6040, AY43-026, AY43-031, sh6062, Z-6911, sz6300, sz6075, sz6079, sz6083, sz6070, sz6072, Z-6721, AY43-004; Z-6187, AY43-021, AY43-043, AY43-040, AY43-047, Z-6265, AY43-204M, AY43-048, Z-6403, AY43-206M, AY43-206E, Z6341, AY43-210MC, AY43-083, AY43-101, AY43-013, AY43-158E, Z-6920, and Z-6940 (produced by TORAY Silicone Co., Ltd.).

The amount of the silane coupling agent added to the silicone resin is preferably 0.1% by mass to 10% by mass. When the additive amount of the silane coupling agent is less than 0.1% by mass, the adhesiveness of silicone resin with respect to the core material particles and conductive particles degrades, and the coating layer may drop off in a long term use. When it is more than 10% by mass, toner filming may occur in a long term use.

The coating layer preferably has an average thickness of 0.05 μm to 4 μm. When the average thickness is less than 0.05 μm, the coating layer easily fractures, and the layer may peel off. When it is more than 4 μm, the resulting carrier may tend to adhere to an image, because the coating layer is not a magnetic material.

The core material particles are not particularly limited as long as the core material particles are composed of a magnetic substance. Examples of the magnetic substance include, but are not limited to, ferromagnetic metals such as iron, and cobalt; iron oxides such as magnetite, hematite, and ferrite; various alloys and alloy compounds; and resin particles in which the magnetic substance is dispersed in a resin. Among these, in consideration of environmental protection, preferred are Mn-ferrite, Mn—Mg ferrite, Mn—Mg—r ferrite and the like.

The core material particles preferably have a weight average particle diameter of 20 μm to 65 μm. When the weight average particle diameter is less than 20 μm, carrier adhesion may occur. When it is more than 65 μm, the reproducibility of image details may degrade, possibly making it impossible to form a fine image.

Here, the weight average particle diameter can be measured using, for example, a microtrack particle size distribution analyzer, Model HRA9320-X100 (manufactured by NIKKISO Co., Ltd.).

The carrier of the present invention preferably has a magnetization of 40 $Am^2/kg$ to 90 $Am^2/kg$ in a magnetic field of 1 kOe($10^6/4\pi$ [A/m]). When this magnetization is lower than 40 $Am^2/kg$, the carrier may adhere to an image. When it is higher than 90 $Am^2/kg$, image thin spots may take place.

The magnetization can be measured using, for example, VSM-P7-15 (manufactured by TOEI INDUSTRY CO., LTD.

The carrier of the present invention preferably has a volume resistivity of $1\times10^9\Omega\cdot cm$ to $1\times10^{17}$ $\Omega\cdot cm$. When the volume resistivity is lower than $1\times10^9$ $\Omega\cdot cm$, carrier adhesion may take place in non-image portions. When it is higher than $1\times10^{17}$ $\Omega\cdot cm$, the edge effect may degrade to an unacceptable level.

The volume resistivity can be measured using, for example, a cell shown in FIG. 1. Specifically, firstly, a carrier 3 is placed in a cell composed of a fluororesin container 2 which accommodates therein an electrode 1*a* and an electrode 1*b* each having a surface area of 2.5 cm×4 cm so as to be located at a distance of 0.2 cm from each other, and the cell is tapped from a dropping height of 1 cm and a tapping speed of 30 times/min. The tapping is repeated 10 times. Thereafter, a DC voltage of 1,000 V is applied to between the electrodes 1*a* and 1*b*, and a resistivity r[Ω] after 30 seconds of the application of the DC voltage is measured using a high resistance meter 4329A (manufactured by Yokokawa Hewlet Packard, Ltd.). Then, a volume resistivity [Ω·cm] of the carrier can be calculated from the expression, r×(2.5>4)/0.2.

(Developer)

A developer according to the present invention contains the carrier of the present invention and a toner.

The toner contains a binder resin and a colorant, and may be a monochrome toner or a color toner. Also, the toner optionally contains a releasing agent in order to be applied to an oilless system where an oil for preventing toner adhesion is not applied to a fixing roller. Typically, a toner of this type is liable to cause filming, however, since the carrier of the present invention can prevent the occurrence of filming, the developer of the present invention can maintain its excellent quality for a long period of time. Further, color toners, in particular, generally, yellow toners have a shortcoming that color contamination occurs due to abrasion of the coating layer of carrier. However, the developer of the present invention can prevent the occurrence of color contamination.

The toner can be produced by a known method such as a pulverization method, and a polymerization method. For example, when a toner is produced by a pulverization method, firstly, a melt-kneaded product obtained by kneading toner materials is cooled, pulverized, and classified to prepare toner base particles. Next, in order to further improve the transferability and durability, an external additive is added to the toner base particles, and a toner is thus produced.

On this occasion, a device for use in kneading the toner materials is not particularly limited. For example, there may be exemplified a batch type kneader using two rolls; a Banbary mixer; biaxial-consecutive kneaders such as a KTK type biaxial extruder (manufactured by KOBE STEEL., LTD.); a TEM type biaxial extruder (manufactured by TOSHIBA MACHINE CO., LTD.), a biaxial extruder (manufactured by KCK); a PCM type biaxial extruder (manufactured by IKEGAI, LTD.), and a KEX type biaxial extruder (manufactured by Kurimoto Ltd.); and uniaxial consecutive kneaders such as a co-kneader (manufactured by BUSS Inc.), etc.

On the occasion that the cooled melt-kneaded product is pulverized, after being coarsely pulverized with a hammer mill, a ROTOPLEX or the like, the melt-kneaded product can be finely pulverized by means of a fine pulverizer using a jet stream, a mechanical fine pulverizer or the like. Note that the melt-kneaded product is preferably pulverized so as to have an average particle diameter of 3 μm to 15 μm.

Further, on the occasion that the pulverized melt-kneaded product is classified, a wind-force classifier etc. can be used. It is preferable that the pulverized melt-kneaded product be classified so that the base particles have an average particle diameter of 5 μm to 20 μm.

On the occasion that an external additive is added to the toner base particles, the external additive and the base particles are mixed and stirred using a mixer or the like, thereby the external additive adheres to surfaces of the base particle while being fused.

The binder resin is not particularly limited and may be suitably selected in accordance with the intended use. Examples thereof include, but are not limited to, styrene and monopolymers of substitution products thereof such as polystyrene, poly-p-styrene, and polyvinyl toluene; styrene copolymers such as styrene-p-chlorostyrene copolymer, styrene-propylene copolymer, styrene-vinyltoluene copolymer, styrene-methyl acrylate copolymer, styrene-ethylacrylate copolymer, styrene-methacrylate copolymer, styrene-methylmethacrylate copolymer, styrene-ethylmethacrylate copolymer, styrene-butylmethacrylate copolymer, styrene-α-chloromethyl methacrylate copolymer, styrene-acrylonitrile copolymer, styrene-vinyl methyl ether copolymer, styrene-vinyl methyl ketone copolymer, styrene-butadiene copolymer, styrene-isoprene copolymer, styrene-maleic ester copolymer; polymethyl methacrylate resins, polybutyl methacrylate resins, polyvinyl chloride resins, polyvinyl acetate resins, polyethylene resins, polyester resins, polyurethane resins, epoxy resins, polyvinyl butyral resins, polyacrylic acid resins, rosins, modified rosins, terpene resins, phenol resins, aliphatic or aromatic hydrocarbon resins, and aromatic petroleum resins. These may be used alone or in combination.

A binder resin for use in pressure fixing is not particularly limited and may be suitably selected in accordance with the intended use. Examples thereof include, but are not limited to, polyolefins such as low-molecular weight polyethylene, and low-molecular weight polypropylene; olefin copolymers such as ethylene-acrylic acid copolymer, ethylene-acrylic ester copolymer, styrene-methacrylic acid copolymer, ethylene-methacrylic ester copolymer, ethylene-vinyl chloride copolymer, ethylene-vinyl acetate copolymer, and ionomer resin; epoxy resins, polyester, styrene-butadiene copolymers, polyvinyl pyrrolidone, methylvinylether-maleic anhydride copolymer, maleic acid-modified phenol resins, and phenol-modified terpene resins. These may be used alone or in combination.

The colorant (pigment or dye) is not particularly limited and may be suitably selected in accordance with the intended use. Examples thereof include, but are not limited to, yellow pigments such as cadmium yellow, mineral fast yellow, nickel titan yellow, navel yellow, naphthol yellow S, hansa yellow G, hansa yellow 10G benzidine yellow GR, quinoline yellow Lake, permanent yellow NCG, tartrazine lake; orange pigments such as molybdenum orange, permanent orange GTR, pyrazolone orange, vulcan orange, indanthrene brilliant orange RK, benzidine orange G, and indanthrene brilliant orange GK; red pigments such as colcothar, cadmium red, permanent red 4R, lithol-red pyrazolone red, Watchung-red Calcium-salt, lake red D, brilliant carmine 6B, eosin lake, rhodamine lake B, alizarin lake, and brilliant carmine 3B; violet pigments such as fast violet B, and methyl violet; blue pigments such as cobalt blue, alkali blue, Victoria blue lake, phthalocyanine blue, metal-free phthalocyanine blue, partially chlorinated phthalocyanine blue, fast sky blue, and indanthrene blue BC; green pigments such as chrome green, chrome oxide, pigment green B, and malachite green lake; azine pigments such as carbon black, oil furnace black, channel black, lamp black, acetylene black, and aniline black; and black pigments such as metal salt azo pigments, metal oxides, and composite metal oxides. These may be used alone or in combination.

The releasing agent is not particularly limited and may be suitably selected in accordance with the intended use. Examples thereof include, but are not limited to, polyolefins such as polyethylene, and polypropylene; fatty acid metal salts, fatty acid ester, paraffin wax, amide wax, polyhydric alcohol wax, silicone varnish, carnauba wax, and ester wax. These may be used alone or in combination.

The toner may further contain a charge controlling agent. The charge controlling agent is not particularly limited and may be suitably selected in accordance with the intended use. Examples thereof include, but are not limited to, nigrosine; azine dyes containing an alkyl group having 2 to 16 carbon atoms (refer to Japanese Patent Application Publication (JP-B) No. 42-1627); basic dyes such as C.I. Basic Yellow 2 (C.I. 41000), C.I. Basic Yellow 3, C.I. Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 (C.I. 52025), C.I. Basic Blue 26 (C.I. 44045), C.I. Basic Green 1 (C.I. 42040), and C.I. Basic Green 4 (C.I. 42000); lake pigments of these basic dyes; quaternary ammonium salts such as C.I. Solvent Black 8 (C.I. 26150), benzoylmethylhexadecylammonium chloride, and decyl trimethyl chloride; dialkyl tin compounds such as dibutyl, and dioctyl; dialkyl tin borate compounds; guanidine derivatives; polyamine resins such as a vinyl polymer having an amino group, and a condensed polymer having an amino group; metal complex salts of monoazo dyes described in Japanese Patent Application Publication (JP-B) Nos. 41-20153, 43-27596, 44-6397, and 45-26478; salicylic acids described in Japanese Patent Application Publication (JP-B) Nos. 55-42752 and 59-7385; metal complexes of Zn, Al, Co, Cr, and Fe with dialkyl salicylic acid, naphthoic acid, or dicarboxylic acid; sulfonated copper phthalocyanine pigments; organic boron salts; fluorine-containing quaternary ammonium salts; and calyx allene compounds. These may be used alone or in combination. Note that for color toners other than black toner, metal salts of white salicylic acid derivatives are preferred.

The external additive is not particularly limited and may be suitably selected in accordance with the intended use. Examples thereof include, but are not limited to, inorganic particles such as silica, titanium oxide, alumina, silicon carbide, silicone nitride, and boron nitride; and resin particles having an average particle diameter of 0.05 μm to 1 μm, which are obtained by a soap-free emulsification polymerization method, such as polymethyl methacrylate particles, and polystyrene particles. These may be used alone or in combination. Among these, preferred are metal oxide particles such as silica particles, and titanium oxide particles whose surfaces have been hydrophobized. Further, by using silica particles which have been hydrophobized in combination with titanium oxide particles which have been hydrophobized so that the additive amount of the hydrophobized titanium oxide particles is larger than that of the hydrophobized silica particles, a toner excellent in charge stability to humidity can be obtained.

(Image Forming Method)

An image forming method according to the present invention includes at least a latent electrostatic image formi ng step, a developing step, a transferring step and a fixing step, and further includes other steps suitably selected in accordance with the necessity, such as a charge eliminating step, a cleaning step, a recycling step, and a controlling step.

-Latent Electrostatic Image Forming Step-

In the latent electrostatic image forming step, a latent electrostatic image is formed on a latent electrostatic image bearing member.

The latent electrostatic image bearing member (otherwise referred to as "electrophotographic photoconductor" or "photoconductor") is not particularly limited as to the material, shape, structure, size, and the like and may be suitably selected from among known latent electrostatic image bearing members. As to the shape there, preferred is a drum shape. The materials are, for example, inorganic photoconductors such as amorphous silicon, and selenium; and organic photoconductors (OPC) such as polysilane, and phthalopolymethine. Among these materials, amorphous silicons or the like are preferred in terms of the longer operating life.

The latent electrostatic image can be formed by, for example, charging the surface of the latent electrostatic image bearing member uniformly and then exposing the surface imagewise, by means of a latent electrostatic image forming unit. The latent electrostatic image forming unit includes, for example, at least a charger for charging the surface of the latent electrostatic image bearing member uniformly and an exposing unit for exposing the surface of the latent electrostatic image bearing member imagewise.

The charging can be performed by applying electric voltage to the surface of the latent electrostatic image bearing member using, for example, the charger.

The charger is not particularly limited and may be selected in accordance with the intended use. Examples of the charger include a known contact type charger equipped with a conductive or semi-conductive roll, brush, film, rubber blade or the like; and a noncontact-type charger which utilizes corona discharge such as corotron, and scorotron.

Preferably the charger is located in contact with or in non-contact with a latent electrostatic image bearing member to charge the surface of the latent electrostatic image bearing member by superimposing a direct current voltage with an alternating voltage.

The charger is also preferably a charge roller which is located near and in non-contact with a latent electrostatic image bearing member via a gap tape, in which the surface of the latent electrostatic image bearing member is charged by superimposing a direct current voltage and an alternating voltage to the charge roller. The exposure can be performed by exposing the surface of the latent electrostatic image bearing member imagewise using, for example, an exposing device.

The exposing device is not particularly limited, provided that exposure can be performed imagewise, as in the appearance of the image to be formed, on the surface of the latent electrostatic image bearing member, and it may be selected in accordance with the intended use. For example, there are various types of exposing devices such as photocopy optical systems, rod lens array systems, laser beam systems, and liquid-crystal shutter optical systems.

In the present invention, an optical backside process may be employed, in which exposures are performed imagewise from the back side of the latent electrostatic image bearing member.

-Developing Step-

In the developing step, the latent electrostatic image is developed using the developer of the present invention to form a visible image.

The visible image can be formed by developing the latent electrostatic image using, for example, the developer of the present invention and by means of a developing unit.

The developing unit is not particularly limited, provided that images can be developed using the developer of the present invention, and may be suitably selected from those known in the art. Preferred examples of the developing unit include the one that houses the developer of the present invention and includes a developing device which can supply the developer in contact with or in non-contact with the latent electrostatic image. More preferred is a developing device equipped with a container containing the developer.

The image developing device may be based on a dry-developing process or a wet-developing process, and also may be the one for monochrome or for multicolor. For example, an image developing device which includes an agitator for frictionally agitating the developer to be charged; and a rotatable magnet roller, is preferable.

In the image developing device, for example, the toner and the carrier are mixed and agitated, and the toner is charged by friction at that time to be held in the state where the toner is standing on the surface of the rotating magnet roller to form a magnetic brush. Since the magnet roller is disposed near the latent electrostatic image bearing member, i.e. the photoconductor, a part of the toner constituting the magnet brush formed on the surface of the magnet roller moves onto the surface of the latent electrostatic image bearing member by electrical attraction force. As a result, the latent electrostatic image is developed through the use of the toner to form a visible image composed of the toner on the surface of the latent electrostatic image bearing member. A developer to be housed in the developing device is the developer of the present invention.

-Transferring Step-

In the transferring step, the visible image is transferred onto a recording medium. A preferred aspect is a transferring step in which an intermediate transfer member is used, a visible image is primarily transferred onto the intermediate transfer member, and then the visible image is secondarily transferred onto the recording medium. A more preferred aspect is a transferring step which includes a primary transfer step of transferring a visible image formed using, as the toner, two or more color toners, preferably using full color toners, onto an intermediate transfer member to form a composite transfer image; and a secondary transfer step of transferring the composite transfer image onto a recording medium.

The transferring can be performed by charging the visible image on the latent electrostatic image bearing member i.e. photoconductor using, for example, a transfer charger, and by means of the transfer unit. As the transfer unit, a preferred aspect is a transfer unit which includes a primary transfer unit configured to transfer a visible image onto an intermediate transfer member to form a composite transfer image and a secondary transfer unit configured to transfer the composite transfer image onto a recording medium.

The intermediate transfer member is not particularly limited and may be suitably selected from among known transfer members. For example, a transfer belt and the like are preferably exemplified.

Preferably, the transfer unit (the primary transfer unit and the secondary transfer unit) includes at least an image transfer device which can peel-off charge the visible image formed on the latent electrostatic image bearing member (photoconductor) toward the recording medium. One transfer unit or two or more transfer units may be used. Examples of the image-transfer device include corona transfer units utilizing corona discharge electrodes, transfer belts, transfer rollers, pressure transfer rollers and adhesion transfer units.

The recording medium is not particularly limited and may be suitably selected from among known recording media (recording paper).

-Fixing Step-

In the fixing step, the visible image transferred onto the recording medium is fixed using a fixing device. Fixation of the image may be carried out every time each color developer is transferred onto the recording medium or may be carried out at a time in a state where visible images of individual color toners are superimposed on the recording medium.

The fixing unit is not particularly limited and may be suitably selected in accordance with the intended use, however, a heating/pressurizing unit known in the art is preferable. Examples of the heating/pressurizing unit include a combination of a heating roller and a pressuring roller, and a combination of a heating roller, a pressurizing roller and an endless belt.

The fixing device is preferably a fixing unit which includes a heater equipped with a heating element, a film provided in contact with the heater, and a pressurizing member press-contacted with the heater via the film, and which is configured to pass a recording medium carrying on its surface an unfixed image through the space between the film and the pressurizing member. The heating temperature of the heating/pressurizing unit is preferably 80° C. to 200° C.

Note that in the present invention, for example, a photofixing device may be used together with or instead of the fixing step and the fixing unit.

In the charge eliminating step, a charge eliminating bias is applied to the latent electrostatic image bearing member to eliminate charge therefrom. The elimination of charge can be preferably carried out by means of a charge eliminating device.

The charge eliminating device is not particularly limited provided that it can apply a charge eliminating bias to the latent electrostatic image bearing member, and it may be suitably selected from among charge eliminating devices known in the art. For example, a charge eliminating lamp device and the like are preferably exemplified.

In the cleaning step, the toner remaining on the latent electrostatic image bearing member is removed, and it can be preferably carried out by means of a cleaning unit.

The cleaning unit is not particularly limited provided that it can remove the toner remaining on the latent electrostatic image bearing member, and may be suitably selected from among known cleaners. Preferred examples thereof include a magnetic brush cleaner, an electrostatic brush cleaner, a magnetic roller cleaner, a blade cleaner, a brush cleaner, and a web cleaner.

In the recycling step, the toner removed in the cleaning step is recycled in the developing unit, and it can be favorably carried out by means of a recycling unit.

The recycling unit is not particularly limited, and a known conveyance unit and the like are preferably exemplified.

In the controlling step, each of the steps described above is controlled, and these steps can be favorably carried out by means of a controlling unit.

The controlling unit is not particularly limited provided that it can control the performance of each of the units, and may be suitably selected in accordance with the intended use. Examples thereof include, but are not limited to, equipment such as a sequencer and a computer.

(Process Cartridge)

The process cartridge of the present invention includes at least a latent electrostatic image bearing member which carries, on its surface, a latent electrostatic image, and a developing unit configured to develop the latent electrostatic image carried on the latent electrostatic image bearing member using a developer to form a visible image, and further includes other units suitably selected as required.

The developing unit includes at least a developer housing container to house the developer of the present invention, and a developer bearing member to carry and convey the developer housed in the developer housing container and may include a layer-thickness regulating member to regulate the thickness of a toner layer to be carried on its surface, and other members.

The process cartridge can be mounted on main bodies of various types of electrophotographic image forming apparatuses, however, particularly preferably, the process cartridge is mounted on a main body of an after-mentioned image forming apparatus of the present invention.

Figure 2:
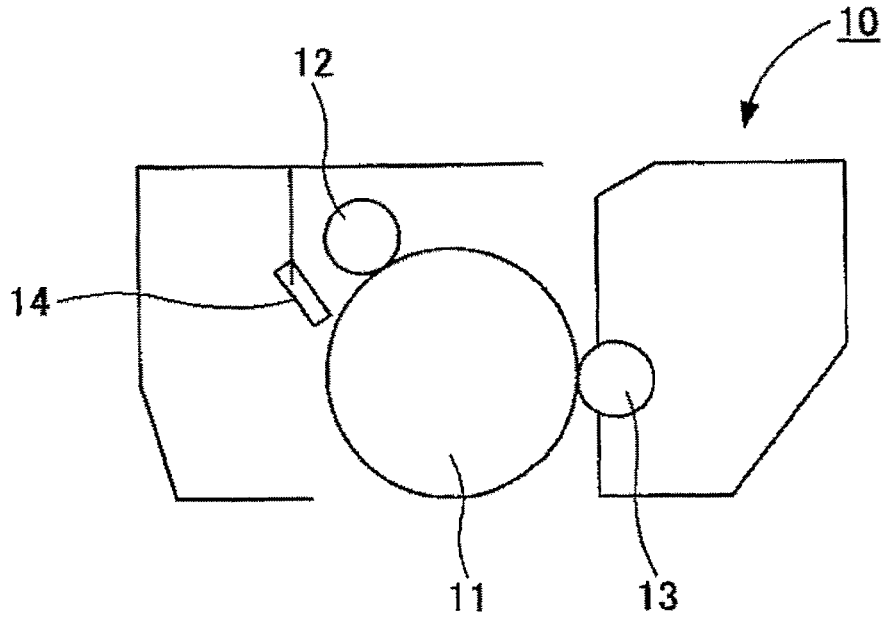
FIG. 2 is a diagram showing one example of a process cartridge according to the present invention.

Here, one example of the process cartridge of the present invention is shown in FIG. 2. A process cartridge 10 includes and integrally supports a photoconductor 11, a charging device 12 which charges a surface of the photoconductor 11, a developing device 13 which develops a latent electrostatic image that has been formed on the surface of the photoconductor 11 using a developer according to the present invention to form a toner image, and a cleaning device 14 which removes toner remaining on the surface of the photoconductor 11 after the toner image formed on the surface of the photoconductor 11 is transferred onto a recording medium. The process cartridge 10 is detachably mounted on a main body of an image forming apparatus such as a copier, and a printer.

The following explains a method for forming an image using an image forming apparatus onto which the process cartridge 10 is mounted. Firstly, the photoconductor 11 is driven to rotate at a predetermined circumferential speed, and a circumjacent surface of the photoconductor 11 is uniformly charged to a predetermined positive or negative potential by the charging device 12. Next, the circumjacent surface of the photoconductor 11 is exposed to exposure light from an exposing device (not shown) such as a slit exposing device, and an exposing device which scans and exposes a photosensitive material with a laser beam, and latent electrostatic images are formed one after another. Further, a latent electrostatic image formed on the circumjacent surface of the photoconductor 11 is developed using the developer of the present invention, by means of the developing device 13, so as to form a toner image. Next, the toner image formed on the circumjacent surface of the photoconductor 11 is synchronized with the rotation of the photoconductor 11 is sequentially transferred onto transfer paper sheets fed from a paper feeding section (not shown) in between the photoconductor 11 and a transfer device (not shown). Further, a transfer paper sheet onto which the toner image has been transferred is separated from the circumjacent surface of the photoconductor 11, introduced into a fixing device (not shown) to be fixed therein and then printed out, as a copy, outside the image forming apparatus. Meanwhile, the surface of the photoconductor 11 after the toner image has been transferred therefrom is cleaned by removing residual toner by means of the cleaning device 14 and then charge removed by a charge eliminating device (not shown) so as to be ready for repeated use in image formation.

The carrier of the present invention is used as a supplemental developer, and by using the supplemental developer in an image forming apparatus for forming an image while discharging an excessive amount of the developer in a developing device of the image forming apparatus, it is possible to obtain stable quality of images for an extremely long period of time. In other words, a deteriorated carrier supplied in a developing device is replaced by a carrier in the supplemental developer which is not deteriorated, and the amount of charge is stably maintained for a long time, thereby making it possible to obtain stable images. This method is effectively used particularly in printing an image having a high image area. When an image having a high image area is printed, a carrier deterioration is caused mainly due to a degradation of charged carrier which is attributable to toner spent to the carrier. However, in printing of an image having a high image area, the use of this method makes it possible to increase the amount of carrier replenished, and thus the frequency of replacement of a deteriorated carrier can be increased. With this, it is possible to obtain a stable image for an extremely long period of time.

In the supplementary developer, it is preferable that the toner in an amount of 2 parts by mass to 50 parts by mass be mixed with 1 part by mass of the carrier. When the amount of the toner is less than 2 parts by mass, the concentration of the carrier in the developing device becomes excessively high due to the excessive amount of the carrier to be replenished, resulting in a tendency that the charged amount of the developer increases. In addition, the increased amount of charge of the developer causes a degradation of developability and a reduction in image density. In contrast, when the amount of the toner mixed with the carrier is more than 50 parts by mass, the amount of carrier to be replaced is reduced in the image forming apparatus due to a reduction in the concentration of the carrier in the supplementary developer, and therefore, it is impossible to expect the effect of preventing degradation of the carrier.

EXAMPLES

Hereinafter, the present invention will be described in detail referring to specific Examples and Comparative Examples, however, the present invention is not limited to the disclosed Examples. It should be noted that "part" or "parts" described below are based on the mass unless otherwise indicated.

Example 1

Two hundred parts of a silicone resin having a solid content of 50% by mass (SR2406, produced by TORAY Dow Corning Silicone Co., Ltd.), and 1,000 parts of toluene were dispersed for 10 minutes using a homomixer to prepare a dispersion liquid. Subsequently, a diluted solution obtained by diluting 2 parts of zirconium tetraacetylacetonate having a solid content of 99% by mass (ZC-150, produced by Matsumoto Fine Chemical Co., Ltd.) with 100 parts of toluene was poured into the dispersion liquid, and stirred for 30 seconds to obtain a coating layer coating liquid.

Using a spiracoater (manufactured by Okada Seiko K.K.) in which the temperature inside the coater had been set to 50° C., the coating layer coating liquid was applied to onto a calcined ferrite powder having a weight average particle diameter of 35 μM so that the resulting coating layer had an average thickness of 0.1 μm, and then dried. Subsequently, the ferrite powder coated with the coating layer was calcined for 1 hour in an electric furnace heated at 250° C., and cooled, followed by shaking on a sieve having openings of 63 thereby obtaining a carrier.

Example 2

A carrier was obtained in the same manner as in Example 1 except that 2.9 parts of zirconium dibutoxy bis(ethylacetoacetate) having a solid content of 70% by mass (ZC-580, produced by Matsumoto Fine Chemical Co., Ltd.) was used instead of 2 parts of zirconium tetraacetylacetonate having a solid content of 99% by mass (ZC-150, produced by Matsumoto Fine Chemical Co., Ltd.).

Example 3

A carrier was obtained in the same manner as in Example 1 except that 2.7 parts of zirconium tetra-n-prop oxide having a solid content of 74% by mass (ZA-40, produced by Matsumoto Fine Chemical Co., Ltd.) was used instead of 2 parts of zirconium tetraacetylacetonate having a solid content of 99% by mass (ZC-150, produced by Matsumoto Fine Chemical Co., Ltd.).

Example 4

A carrier was obtained in the same manner as in Example 1 except that 2.5 parts of zirconium tributoxy monostearate having a solid content of 81% by mass (ZB-320, produced by Matsumoto Fine Chemical Co., Ltd.) was used instead of 2 parts of zirconium tetraacetylacetonate having a solid content of 99% by mass (ZC-150, produced by Matsumoto Fine Chemical Co., Ltd.).

Example 5

Two hundred parts of a silicone resin having a solid content of 50% by mass (SR2406, produced by TORAY Dow Corning Silicone Co., Ltd.), 10 parts of a carbon black (BLACK PORLS 2000, produced by Cabot Specialty Chemicals, Inc.), 10 parts of aminosilane (SH6020, produced by TORAY Dow Corning Silicone Co., Ltd.) and 1,000 parts of toluene were dispersed for 10 minutes using a homomixer to prepare a dispersion liquid. Subsequently, a diluted solution obtained by diluting 2 parts of zirconium tetraacetylacetonate having a solid content of 99% by mass (ZC-150, produced by Matsumoto Fine Chemical Co., Ltd.) with 100 parts of toluene was poured into the dispersion liquid, stirred for 30 seconds, thereby obtaining a coating layer coating liquid.

A carrier was obtained in the same manner as in Example 1 except that the coating layer coating liquid thus obtained was used and applied onto the same kind calcined ferrite powder as used in Example 1 so that the resulting coating layer had an average thickness of 2.0 μm.

Example 6

A carrier was obtained in the same manner as in Example 5 except that 2.9 parts of zirconium dibutoxy bis (ethylacetoacetate) having a solid content of 70% by mass (ZC-580, produced by Matsumoto Fine Chemical Co., Ltd.) was used instead of 2 parts of zirconium tetraacetylacetonate having a solid content of 99% by mass (ZC-150, produced by Matsumoto Fine Chemical Co., Ltd.).

Example 7

One hundred sixty parts of a silicone resin having a solid content of 50% by mass (SR2406, produced by TORAY Dow Corning Silicone Co., Ltd.), 2 parts of zirconium tetraacetylacetonate having a solid content of 99% by mass (ZC-150, produced by Matsumoto Fine Chemical Co., Ltd.), 10 parts of aminosilane (SH6020, produced by TORAY Dow Corning Silicone Co., Ltd.), 60 parts of an acrylic resin having a solid content of 50% by mass (MYCOAT 106, produced by Mitsui Cytech Co., Ltd.), 20 parts of a guanamine resin having a solid content of 50% by mass (HITALOID 3001, produced by Hitachi Chemical Co., Ltd.), 0.3 parts of an acid catalyst having a solid content of 50% by mass (CATALYST 4040, produced by Mitsui Cytech Co., Ltd.), 150 parts of a conductive particle (EC-700, produced by Titan Kogyo Ltd.) and 1,000 parts of toluene were dispersed for 10 minutes using a homomixer to obtain a coating layer coating liquid.

A carrier was obtained in the same manner as in Example 1 except that the coating layer coating liquid thus obtained was used and applied onto the same kind calcined ferrite powder as used in Example 1 so that the resulting coating layer had an average thickness of 0.3 μm.

Example 8

A carrier was obtained in the same manner as in Example 7 except that 2.9 parts of zirconium dibutoxy bis(ethylacetoacetate) having a solid content of 70% by mass (ZC-580, produced by Matsumoto Fine Chemical Co., Ltd.) was used instead of 2 parts of zirconium tetraacetylacetonate having a solid content of 99% by mass (ZC-150, produced by Matsumoto Fine Chemical Co., Ltd.).

Example 9

A carrier was obtained in the same manner as in Example 5 except that the zirconium tetraacetylacetonate having a solid content of 99% by mass (ZC-150, produced by Matsumoto Fine Chemical Co., Ltd.) was used in an amount of 0.6 parts.

Example 10

A carrier was obtained in the same manner as in Example 5 except that the zirconium tetraacetylacetonate having a solid content of 99% by mass (ZC-150, produced by Matsumoto Fine Chemical Co., Ltd.) was used in an amount of 19 parts.

Comparative Example 1

A carrier was obtained in the same manner as in Example 1 except that titanium tetraisopropoxide having a solid content of 99% by mass (TA-10, produced by Matsumoto Fine Chemical Co., Ltd.) was used instead of the zirconium tetraacetylacetonate having a solid content of 99% by mass (ZC-150, produced by Matsumoto Fine Chemical Co., Ltd.).

Comparative Example 2

A carrier was obtained in the same manner as in Example 1 except that 2.7 parts of titanium isopropoxy his (acetylacetonate having a solid content of 75% by mass (TC-100, produced by Matsumoto Fine Chemical Co., Ltd.) was used instead of 2 parts of zirconium tetraacetylacetonate having a solid content of 99% by mass (ZC-150, produced by Matsumoto Fine Chemical Co., Ltd.).

Comparative Example 3

A carrier was obtained in the same manner as in Example 1 except that dibutyltin diacetate (U-200, produced by Nitto Kasei K.K.) was used instead of the zirconium tetraacetylacetonate having a solid content of 99% by mass (ZC-150, produced by Matsumoto Fine Chemical Co., Ltd.).

Comparative Example 4

A carrier was obtained in the same manner as in Example 1 except that dibutyltin oxide (U-300, produced by Nitto Kasei K.K.) was used instead of the zirconium tetraacetylacetonate having a solid content of 99% by mass (ZC-150, produced by Matsumoto Fine Chemical Co., Ltd.).

Comparative Example 5

A carrier was obtained in the same manner as in Example 5 except that titanium tetraisopropoxide having a solid content of 99% by mass (TA-10, produced by Matsumoto Fine Chemical Co., Ltd.) was used instead of the zirconium tetraacetylacetonate having a solid content of 99% by mass (ZC-150, produced by Matsumoto Fine Chemical Co., Ltd.).

Comparative Example 6

A carrier was obtained in the same manner as in Example 5 except that dibutyltin diacetate (U-200, produced by Nitto Kasei K.K.) was used instead of the zirconium tetraacetylacetonate having a solid content of 99% by mass (ZC-150, produced by Matsumoto Fine Chemical Co., Ltd.).

Comparative Example 7

A carrier was obtained in the same manner as in Example 7 except that 2.7 parts of titanium isopropoxy bis (acetylacetonate) having a solid content of 75% by mass (TC-100, produced by Matsumoto Fine Chemical Co., Ltd.) was used instead of 2 parts of zirconium tetraacetylacetonate having a solid content of 99% by mass (ZC-150, produced by Matsumoto Fine Chemical Co., Ltd.).

Comparative Example 8

A carrier was obtained in the same manner as in Example 7 except that dibutyltin oxide (U-300, produced by Nitto Kasei K.K.) was used instead of the zirconium tetraacetylacetonate having a solid content of 99% by mass (ZC-150, produced by Matsumoto Fine Chemical Co., Ltd.).

Next, the carrier formulations of Examples 1 to 10 and Comparative Examples 1 to 8 are shown in Tables 1-1 to 1-4.

TABLE 1-1

| | Solid Content | Ex. 1 | Ex. 2 | Ex. 3 | Ex. 4 | Ex. 5 |
|---|---|---|---|---|---|---|
| silicone resin produced by TORAY Silicone Co., Ltd. SR2406 | 50% | 200 parts | 200 parts | 200 parts | 200 parts | 200 parts |
| Catalyst: zirconium tetraacetylacetonate $Zr(C_5H_7O_2)_4$ produced by Matsumoto Fine Chemical Co., Ltd. ZC-150 | 99% | 2 parts | | | | 2 parts |

TABLE 1-1-continued

| | Solid Content | Ex. 1 | Ex. 2 | Ex. 3 | Ex. 4 | Ex. 5 |
|---|---|---|---|---|---|---|
| Catalyst: zirconium dibutoxy bis(ethylacetoacetate) $Zr(C_5H_7O_2)_4$ produced by Matsumoto Fine Chemical Co., Ltd. ZC-580 | 70% | | 2.9 parts | | | |
| Catalyst: zirconium tetra-normal-propoxide $(O—n-C_3H_7)_4$ produced by Matsumoto Fine Chemical Co., Ltd. ZA-40 | 74% | | | 2.7 parts | | |
| Catalyst: zirconium tributoxy monostearate $(O—n-C_4H_9)_3(OCOC_{17}H_{35})$ produced by Matsumoto Fine Chemical Co., Ltd. ZB-320 | 81% | | | | 2.5 parts | |
| Conductive fine particle (carbon black) produced by Cabot Specialty Chemicals, Inc. BLACK PORLS 2000 | 100% | | | | | 10 parts |
| aminosilane produced by TORAY Dow Corning Silicone Co., Ltd. SH6020 | 100% | | | | | 10 parts |
| acrylic resin | 50% | | | | | |
| guanamine resin | 50% | | | | | |
| acid catalyst | 50% | | | | | |
| Conductive fine particle produced by Titan Kogyo Ltd. EC-700 | 100% | | | | | |
| toluene | 0% | 1,000 parts | 1,000 parts | 1,000 parts | 1,000 parts | 1,000 parts |
| Film Thickness | | 0.1 μm | 0.1 μm | 0.1 μm | 0.1 μm | 2.0 μm |

TABLE 1-2

| | Solid Content | Ex. 6 | Ex. 7 | Ex. 8 | Ex. 9 | Ex. 10 |
|---|---|---|---|---|---|---|
| silicone resin produced by TORAY Silicone Co., Ltd. SR2406 | 50% | 200 parts | 160 parts | 160 parts | 200 parts | 200 parts |
| Catalyst: zirconium tetraacetylacetonate $Zr(C_5H_7O_2)_4$ produced by Matsumoto Fine Chemical Co., Ltd. ZC-150 | 99% | | 2 parts | | 0.6 parts | 19 parts |
| Catalyst: zirconium dibutoxy bis(ethylacetoacetate) $Zr(C_5H_7O_2)_4$ produced by Matsumoto Fine Chemical Co., Ltd. ZC-580 | 70% | 2.9 parts | | 2.9 parts | | |
| Catalyst: zirconium tetra-normal-propoxide $(O—n-C_3H_7)_4$ produced by Matsumoto Fine Chemical Co., Ltd. ZA-40 | 74% | | | | | |
| Catalyst: zirconium tributoxy monostearate $(O—n-C_4H_9)_3(OCOC_{17}H_{35})$ produced by Matsumoto Fine Chemical Co., Ltd. ZB-320 | 81% | | | | | |
| Conductive fine particle (carbon black) produced by Cabot Specialty Chemicals, Inc. BLACK PORLS 2000 | 100% | 10 parts | | | 10 parts | 10 parts |
| aminosilane produced by TORAY Dow Corning Silicone Co., Ltd. SH6020 | 100% | 10 parts | 10 parts | 10 parts | 10 parts | 10 parts |
| acrylic resin | 50% | | 60 parts | 60 parts | | |
| guanamine resin | 50% | | 20 parts | 20 parts | | |
| acid catalyst | 50% | | 0.3 parts | 0.3 parts | | |

TABLE 1-2-continued

| | Solid Content | Ex. 6 | Ex. 7 | Ex. 8 | Ex. 9 | Ex. 10 |
|---|---|---|---|---|---|---|
| Conductive fine particle produced by Titan Kogyo Ltd. EC-700 | 100% | | 150 parts | 150 parts | | |
| toluene | 0% | 1,000 parts | 1,000 parts | 1,000 parts | 1,000 parts | 1,000 parts |
| Film Thickness | | 2.0 μm | 0.3 μm | 0.3 μm | 0.3 μm | 0.3 μm |

TABLE 1-3

| | Solid Content | Comp Ex. 1 | Comp Ex. 2 | Comp Ex. 3 | Comp Ex. 4 | Comp Ex. 5 |
|---|---|---|---|---|---|---|
| silicone resin produced by TORAY Silicone Co., Ltd. SR2406 | 50% | 200 parts | 200 parts | 200 parts | 200 parts | 200 parts |
| Catalyst: zirconium tetraacetylacetonate $Zr(C_5H_7O_2)_4$ produced by Matsumoto Fine Chemical Co., Ltd. ZC-150 | 99% | 2 parts | | | | 2 parts |
| Catalyst: zirconium dibutoxy bis(ethylacetoacetate) $Zr(C_5H_7O_2)_4$ produced by Matsumoto Fine Chemical Co., Ltd. ZC-580 | 70% | | 2.7 parts | | | |
| Catalyst: zirconium tetra-normal-propoxide (O—n-$C_3H_7)_4$ produced by Matsumoto Fine Chemical Co., Ltd. ZA-40 | 74% | | | 2 parts | | |
| Catalyst: zirconium tributoxy monostearate (O—n-$C_4H_9)_3(OCOC_{17}H_{35})$ produced by Matsumoto Fine Chemical Co., Ltd. ZB-320 | 81% | | | | 2 parts | |
| Conductive fine particle (carbon black) produced by Cabot Specialty Chemicals, Inc. BLACK PORLS 2000 | 100% | | | | | 10 parts |
| aminosilane produced by TORAY Dow Corning Silicone Co., Ltd. SH6020 | 100% | | | | | 10 parts |
| acrylic resin | 50% | | | | | |
| guanamine resin | 50% | | | | | |
| acid catalyst | 50% | | | | | |
| Conductive fine particle produced by Titan Kogyo Ltd. EC-700 | 100% | | | | | |
| toluene | 0% | 1,000 parts | 1,000 parts | 1,000 parts | 1,000 parts | 1,000 parts |
| Film Thickness | | 0.1 μm | 0.1 μm | 0.1 μm | 0.1 μm | 2.0 μm |

TABLE 1-4

| | Solid Content | Comp. Ex. 6 | Comp. Ex. 7 | Comp. Ex. 8 |
|---|---|---|---|---|
| silicone resin produced by TORAY Silicone Co., Ltd. SR2406 | 50% | 200 parts | 160 parts | 160 parts |
| Catalyst: zirconium tetraacetylacetonate $Zr(C_5H_7O_2)_4$ produced by Matsumoto Fine Chemical Co., Ltd. ZC-150 | 99% | | | |
| Catalyst: zirconium dibutoxy bis(ethylacetoacetate) $Zr(C_5H_7O_2)_4$ produced by Matsumoto Fine Chemical Co., Ltd. ZC-580 | 70% | | 2.7 parts | |

TABLE 1-4-continued

| | Solid Content | Comp. Ex. 6 | Comp. Ex. 7 | Comp. Ex. 8 |
|---|---|---|---|---|
| Catalyst: zirconium tetra-normal-propoxide (O-n-$C_3H_7)_4$ produced by Matsumoto Fine Chemical Co., Ltd. ZA-40 | 74% | 2 parts | | |
| Catalyst: zirconium tributoxy monostearate (O-n-$C_4H_9)_3(OCOC_{17}H_{35})$ produced by Matsumoto Fine Chemical Co., Ltd. ZB-320 | 81% | | | 2 parts |
| Conductive fine particle (carbon black) produced by Cabot Specialty Chemicals, Inc. BLACK PORLS 2000 | 100% | 10 parts | | |

TABLE 1-4-continued

| | Solid Content | Comp. Ex. 6 | Comp. Ex. 7 | Comp. Ex. 8 |
|---|---|---|---|---|
| aminosilane produced by TORAY Dow Corning Silicone Co., Ltd. SH6020 | 100% | 10 parts | 10 parts | 10 parts |
| acrylic resin | 50% | | 60 parts | 60 parts |
| guanamine resin | 50% | | 20 parts | 20 parts |
| acid catalyst | 50% | | 0.3 parts | 0.3 parts |
| Conductive fine particle produced by Titan Kogyo Ltd. EC-700 | 100% | | 150 parts | 150 parts |
| toluene | 0% | 1,000 parts | 1,000 parts | 1,000 parts |
| Film Thickness | | 2.0 μm | 0.3 μm | 0.3 μm |

Next, each of the carriers (including the core material particles and the coating layer) produced as above was evaluated for various physical properties in the following manners. The evaluation results are shown in Table 2-1 and 2-2.

[Weight Average Particle Diameter of Core Material Particles]

A particle size distribution of the core material particles was measured by means of a microtrack particle size distribution analyzer, Model HRA9320-X100 (manufactured by NIKKISO Co., Ltd.).

[Average Thickness of Coating Layer]

An average thickness of the coating layer was measured by observing a cross-section of the carrier, using a transmission type electron microscope (TEM).

[Volume Resistivity]

A volume resistivity of the carrier was measured using a cell shown in FIG. 1. Specifically, firstly, a carrier 3 was placed in a cell composed of a fluororesin container 2 accommodating therein an electrode la and an electrode 1*b* each having a surface area of 2.5 cm×4 cm so as to be located at a distance of 0.2 cm from each other, and the cell was tapped from a dropping height of 1 cm and a tapping speed of 30 times/min. The tapping was repeated 10 times. Thereafter, a DC voltage of 1,000 V was applied to between the electrodes 1*a* and 1*b*, and a resistivity r[Ω] after 30 seconds of the application of the DC voltage was measured using a high resistance meter 4329A (manufactured by Yokokawa Hewlet Packard, Ltd.). Then, a volume resistivity [Ω·cm] of the carrier was calculated from the expression, r×(2.5×4)/0.2.

[Magnetization in Magnetic Field of 1 kOe]

A cell having an internal diameter of 2.4 mm and a height of 8.5 mm was filled with 0.15 g of the carrier, and then a magnetization of the carrier in a magnetic field of 1 kOe was measured using VSM-P7-15 (manufactured by TOEI INDUSTRY CO., LTD.).

[Degree of Blocking of Carrier after Calcination]

The calcined ferrite powder that had been coated with the coating layer coating liquid and dried was calcined for 1 hour in an electric furnace heated at 250° C., and cooled, and the degree of blocking was evaluated according to the following criteria.

A: The carrier particles were not coagulated at all.

B: The carrier particles were coagulated but easily broken apart to be powdery.

C: The carrier particles were coagulated but broken apart by shaking it on a sieve having openings of 63 μm.

D: The carrier particles were completely coagulated and could not be broken apart by just shaking it on a sieve having openings of 63 μm.

TABLE 2-1

| | Ex. 1 | Ex. 2 | Ex. 3 | Ex. 4 | Ex. 5 | Ex. 6 | Ex. 7 | Ex. 8 | Ex. 9 | Ex. 10 |
|---|---|---|---|---|---|---|---|---|---|---|
| Degree of blocking after calcination | B | B | B | B | B | B | A | B | B | B |
| Volume resistivity [Ω · cm] | $1.7 \times 10^{16}$ | $2.1 \times 10^{16}$ | $1.9 \times 10^{16}$ | $1.8 \times 10^{16}$ | $6.5 \times 10^{13}$ | $7.5 \times 10^{13}$ | $8.9 \times 10^{11}$ | $9.0 \times 10^{11}$ | $6.4 \times 10^{13}$ | $6.6 \times 10^{13}$ |
| Magnetization (in a magnetic field of 1 Koe) [$Am^2/kg$] | 71 | 71 | 71 | 71 | 71 | 71 | 71 | 71 | 71 | 71 |

TABLE 2-2

| | Comp. Ex. 1 | Comp. Ex. 2 | Comp. Ex. 3 | Comp. Ex. 4 | Comp. Ex. 5 | Comp. Ex. 6 | Comp. Ex. 7 | Comp. Ex. 8 |
|---|---|---|---|---|---|---|---|---|
| Degree of blocking after calcination | D | D | B | C | D | B | D | C |
| Volume resistivity [Ω · cm] | $2.2 \times 10^{16}$ | $2.0 \times 10^{16}$ | $2.6 \times 10^{16}$ | $2.4 \times 10^{16}$ | $6.9 \times 10^{13}$ | $7.2 \times 10^{13}$ | $8.8 \times 10^{11}$ | $9.1 \times 10^{11}$ |
| Magnetization (in a magnetic field of 1 Koe) [$Am^2/kg$] | 71 | 71 | 71 | 71 | 71 | 71 | 71 | 71 |

The results shown in Table 2-1 and 2-2 demonstrated that carriers of Examples 1 to 10 and Comparative Examples 3 and 6 hardly cause blocking during calcination and have high productivity. This can be considered that since a condensation reaction of the silicone resin adequately proceeds during the time where the coating layer coating liquid is applied to the calcined ferrite powder and dried, and it is possible to prevent the silicone resin from being bound to adjacent calcined ferrite powder particles during the calcination.

Next, each image formed using the individual carriers was evaluated in the following manner. The evaluation results are shown in Tables 3-1 to 3-4.

<Evaluation of Image>

Evaluation of images was performed using a digital full color multifunction machine (IMAGIO NEO C600, manufactured by Ricoh Company Ltd.). Specifically, firstly, each of the carriers of Examples and Comparative Examples and each toner of four color toners used in IMAGIO NEO C600, i.e. a black toner (IMAGIO Toner Type: 2 Black), a yellow toner (IMAGIO Toner Type: 2 Yellow), a magenta toner (IMAGIO Toner Type: 2 Magenta) or a cyan toner (IMAGIO Toner Type: 2 Cyan) were mixed at a mass ratio of 93:7 so as to obtain four color developers. Subsequently, using each of the developers thus obtained, a running test of 100,000 sheets was performed with an image having an image area of 20%. A charge amount and a volume resistivity of the carrier were measured at the initial stage of the running test and after the running test. Then, a reduced amount of charge and an amount of change in volume resistivity were calculated.

-Charge Amount of Carrier-

The charge amount of the carrier at the initial stage of the running test was measured in the following manner. The carrier and the black toner were mixed at a mass ratio of 93:7 and frictionally charged to prepare a sample, and the sample was subjected to measurement of charge amount using a Blow-Off Powder Charge Meter (Model TB-200, manufactured by Toshiba Chemical K.K.). The charge amount of the carrier after the running test was measured in the same manner as in the measurement of charge amount at the initial stage of the running test except that each color toner was removed from the color developer that had undergone the running test to obtain only carrier, and the resulting carrier was used for the measurement. Note that the target reduced amount of charge was 10 μg or lower.

-Volume Resistivity of Carrier-

The volume resistivity measured at the initial stage of the running test is a common logarithm value of a volume resistivity of carrier measured in the manner described above. The volume resistivity of the carrier after the running test was measured in the same manner as in the measurement of volume resistivity at the initial stage of the running test except that each color toner was removed from the color developer that had undergone the running test to obtain only carrier, and the resulting carrier was used for the measurement. Note that a target amount of change in volume resistivity was an absolute value of 1.5[Log(Ω·cm)] or lower.

TABLE 3-1

| | | Ex. 1 | Ex. 2 | Ex. 3 | Ex. 4 | Ex. 5 |
|---|---|---|---|---|---|---|
| Black | Amount of charge (Q1) [μC/g] | 40 | 38 | 41 | 39 | 35 |
| | Amount of charge (Q2) [μC/g] | 35 | 32 | 36 | 33 | 31 |
| | Amount of charge (Q1 − Q2) [μC/g] | 5 | 6 | 5 | 6 | 4 |
| Yellow | Amount of charge (Q1) [μC/g] | 40 | 38 | 41 | 39 | 35 |
| | Amount of charge (Q2) [μC/g] | 36 | 31 | 34 | 32 | 31 |
| | Amount of charge (Q1 − Q2) [μC/g] | 4 | 7 | 7 | 7 | 4 |
| Magenta | Amount of charge (Q1) [μC/g] | 40 | 38 | 41 | 39 | 35 |
| | Amount of charge (Q2) [μC/g] | 34 | 30 | 33 | 31 | 32 |
| | Amount of charge (Q1 − Q2) [μC/g] | 6 | 8 | 8 | 8 | 3 |
| Cyan | Amount of charge (Q1) [μG/g] | 40 | 38 | 41 | 39 | 35 |
| | Amount of charge (Q2) [μC/g] | 36 | 33 | 33 | 34 | 32 |
| | Amount of charge (Q1 − Q2) [μC/g] | 4 | 5 | 8 | 5 | 3 |
| Black | Initial volume resistivity [Lgo(Ω · cm)] | 16.2 | 16.3 | 16.3 | 16.3 | 13.8 |
| | Volume resistivity after outputting 100,000 sheets [Lgo(Ω · cm)] | 16.9 | 16.9 | 17.1 | 17.2 | 14.5 |
| | Difference in volume resistivity | −0.7 | −0.6 | −0.8 | −0.9 | −0.7 |
| Yellow | Initial volume resistivity [Lgo(Ω · cm)] | 16.2 | 16.3 | 16.3 | 16.3 | 13.8 |
| | Volume resistivity after outputting 100,000 sheets [Lgo(Ω · cm)] | 17.0 | 17.2 | 17.3 | 17.4 | 15.0 |
| | Difference in volume resistivity | −0.8 | −0.9 | −1.0 | −1.1 | −1.2 |
| Magenta | Initial volume resistivity [Lgo(Ω · cm)] | 16.2 | 16.3 | 16.3 | 16.3 | 13.8 |
| | Volume resistivity after outputting 100,000 sheets [Lgo(Ω · cm)] | 16.9 | 17.1 | 17.4 | 17.3 | 14.9 |
| | Difference in volume resistivity | −0.7 | −0.8 | −1.1 | −1.0 | −1.1 |
| Cyan | Initial volume resistivity [Lgo(Ω · cm)] | 16.2 | 16.3 | 16.3 | 16.3 | 13.8 |
| | Volume resistivity after outputting 100,000 sheets [Lgo(Ω · cm)] | 16.9 | 17.0 | 17.3 | 17.3 | 14.9 |
| | Difference in volume resistivity | −0.7 | −0.7 | −1.0 | −1.0 | −1.1 |

TABLE 3-2

| | | Ex. 6 | Ex. 7 | Ex. 8 | Ex. 9 | Ex. 10 |
|---|---|---|---|---|---|---|
| Black | Amount of charge (Q1) [μC/g] | 34 | 31 | 32 | 34 | 36 |
| | Amount of charge (Q2) [μC/g] | 29 | 27 | 27 | 30 | 33 |
| | Amount of charge (Q1 − Q2) [μC/g] | 5 | 4 | 5 | 4 | 3 |

TABLE 3-2-continued

| | | Ex. 6 | Ex. 7 | Ex. 8 | Ex. 9 | Ex. 10 |
|---|---|---|---|---|---|---|
| Yellow | Amount of charge (Q1) [μC/g] | 34 | 31 | 32 | 34 | 37 |
| | Amount of charge (Q2) [μC/g] | 30 | 27 | 27 | 29 | 32 |
| | Amount of charge (Q1 − Q2) [μC/g] | 4 | 4 | 5 | 5 | 5 |
| Magenta | Amount of charge (Q1) [μC/g] | 34 | 31 | 32 | 36 | 38 |
| | Amount of charge (Q2) [μC/g] | 28 | 28 | 26 | 30 | 35 |
| | Amount of charge (Q1 − Q2) [μC/g] | 6 | 3 | 6 | 6 | 3 |
| Cyan | Amount of charge (Q1) [μC/g] | 34 | 31 | 32 | 33 | 37 |
| | Amount of charge (Q2) [μC/g] | 28 | 29 | 25 | 30 | 35 |
| | Amount of charge (Q1 − Q2) [μC/g] | 6 | 2 | 7 | 3 | 2 |
| Black | Initial volume resistivity [Lgo(Ω · cm)] | 13.9 | 11.9 | 12.0 | 13.8 | 13.8 |
| | Volume resistivity after outputting 100,000 sheets [Lgo(Ω · cm)] | 14.7 | 12.7 | 13.0 | 14.3 | 14.3 |
| | Difference in volume resistivity | −0.8 | −0.8 | −1.0 | −0.5 | −0.5 |
| Yellow | Initial volume resistivity [Lgo(Ω · cm)] | 13.9 | 11.9 | 12.0 | 13.8 | 13.8 |
| | Volume resistivity after outputting 100,000 sheets [Lgo(Ω · cm)] | 15.1 | 13.0 | 13.2 | 14.8 | 14.5 |
| | Difference in volume resistivity | −1.2 | −1.1 | −1.2 | −1.0 | −0.7 |
| Magenta | Initial volume resistivity [Lgo(Ω · cm)] | 13.9 | 11.9 | 12.0 | 13.8 | 13.8 |
| | Volume resistivity after outputting 100,000 sheets [Lgo(Ω · cm)] | 15.1 | 13.2 | 13.3 | 14.7 | 14.7 |
| | Difference in volume resistivity | −1.2 | −1.3 | −1.3 | −0.9 | −0.9 |
| Cyan | Initial volume resistivity [Lgo(Ω · cm)] | 13.9 | 11.9 | 12.0 | 13.8 | 13.8 |
| | Volume resistivity after outputting 100,000 sheets [Lgo(Ω · cm)] | 15.0 | 13.1 | 13.2 | 14.8 | 14.5 |
| | Difference in volume resistivity | −1.1 | −1.2 | −1.2 | −1.0 | −0.7 |

TABLE 3-3

| | | Comp. Ex. 1 | Comp. Ex. 2 | Comp. Ex. 3 | Comp. Ex. 4 | Comp. Ex. 5 |
|---|---|---|---|---|---|---|
| Black | Amount of charge (Q1) [μC/g] | 39 | 37 | 41 | 39 | 34 |
| | Amount of charge (Q2) [μC/g] | 20 | 21 | 20 | 23 | 17 |
| | Amount of charge (Q1 − Q2) [μC/g] | 19 | 16 | 21 | 16 | 17 |
| Yellow | Amount of charge (Q1) [μC/g] | 39 | 37 | 41 | 39 | 34 |
| | Amount of charge (Q2) [μC/g] | 20 | 21 | 23 | 21 | 18 |
| | Amount of charge (Q1 − Q2) [μC/g] | 19 | 16 | 18 | 18 | 16 |
| Magenta | Amount of charge (Q1) [(μC/g] | 39 | 37 | 41 | 39 | 34 |
| | Amount of charge (Q2) [μC/g] | 20 | 21 | 25 | 20 | 19 |
| | Amount of charge (Q1 − Q2) [μC/g] | 19 | 16 | 16 | 19 | 15 |
| Cyan | Amount of charge (Q1) [μC/g] | 39 | 37 | 41 | 39 | 34 |
| | Amount of charge (Q2) [μC/g] | 20 | 21 | 23 | 24 | 20 |
| | Amount of charge (Q1 − Q2) [μC/g] | 19 | 16 | 18 | 15 | 14 |
| Black | Initial volume resistivity [Lgo(Ω · cm)] | 16.3 | 16.3 | 16.4 | 16.4 | 13.8 |
| | Volume resistivity after outputting 100,000 sheets [Lgo(Ω · cm)] | 17.2 | 17.3 | 17.5 | 17.3 | 15.0 |
| | Difference in volume resistivity | −0.9 | −1.0 | −1.1 | −0.9 | −1.2 |
| Yellow | Initial volume resistivity [Lgo(Ω · cm)] | 16.3 | 16.3 | 16.4 | 16.4 | 13.8 |
| | Volume resistivity after outputting 100,000 sheets [Lgo(Ω · cm)] | 17.6 | 17.5 | 17.7 | 17.9 | 15.5 |
| | Difference in volume resistivity | −1.3 | −1.2 | −1.3 | −1.5 | −1.7 |
| Magenta | Initial volume resistivity [Lgo(Ω · cm)] | 16.3 | 16.3 | 16.4 | 16.4 | 13.8 |
| | Volume resistivity after outputting 100,000 sheets [Lgo(Ω · cm)] | 17.6 | 17.4 | 17.9 | 17.9 | 15.6 |
| | Difference in volume resistivity | −1.3 | −1.1 | −1.5 | −1.5 | −1.8 |
| Cyan | Initial volume resistivity [Lgo(Ω · cm)] | 16.3 | 16.3 | 16.4 | 16.4 | 13.8 |
| | Volume resistivity after outputting 100,000 sheets [Lgo(Ω · cm)] | 17.7 | 17.4 | 17.5 | 18.0 | 15.6 |
| | Difference in volume resistivity | −1.4 | −1.1 | −1.1 | −1.6 | −1.8 |

TABLE 3-4

| | | Comp. Ex. 6 | Comp. Ex. 7 | Comp. Ex. 8 |
|---|---|---|---|---|
| Black | Amount of charge (Q1) [μC/g] | 33 | 30 | 29 |
| | Amount of charge (Q2) [μC/g] | 18 | 19 | 15 |
| | Amount of charge (Q1 − Q2) [μC/g] | 15 | 11 | 14 |
| Yellow | Amount of charge (Q1) [μC/g] | 33 | 30 | 29 |
| | Amount of charge (Q2) [μC/g] | 16 | 18 | 14 |
| | Amount of charge (Q1 − Q2) [μC/g] | 17 | 12 | 15 |
| Magenta | Amount of charge (Q1) [μC/g] | 33 | 30 | 29 |
| | Amount of charge (Q2) [μC/g] | 20 | 18 | 13 |
| | Amount of charge (Q1 − Q2) [μC/g] | 13 | 12 | 16 |
| Cyan | Amount of charge (Q1) [μC/g] | 33 | 30 | 29 |
| | Amount of charge (Q2) [μC/g] | 19 | 17 | 16 |
| | Amount of charge (Q1 − Q2) [μC/g] | 14 | 13 | 13 |
| Black | Initial volume resistivity [Lgo(Ω · cm)] | 13.9 | 11.9 | 12.0 |
| | Volume resistivity after outputting 100,000 sheets [Lgo(Ω · cm)] | 14.9 | 12.8 | 13.0 |
| | Difference in volume resistivity | −1.0 | −0.9 | −1.0 |
| Yellow | Initial volume resistivity [Lgo(Ω · cm)] | 13.9 | 11.9 | 12.0 |
| | Volume resistivity after outputting 100,000 sheets [Lgo(Ω · cm)] | 15.3 | 13.5 | 13.6 |
| | Difference in volume resistivity | −1.4 | −1.6 | −1.6 |
| Magenta | Initial volume resistivity [Lgo(Ω · cm)] | 13.9 | 11.9 | 12.0 |
| | Volume resistivity after outputting 100,000 sheets [Lgo(Ω · cm)] | 15.4 | 13.5 | 13.6 |
| | Difference in volume resistivity | −1.5 | −1.6 | −1.6 |
| Cyan | Initial volume resistivity [Lgo(Ω · cm)] | 13.9 | 11.9 | 12.0 |
| | Volume resistivity after outputting 100,000 sheets [Lgo(Ω · cm)] | 15.5 | 13.7 | 13.7 |
| | Difference in volume resistivity | −1.6 | −1.8 | −1.7 |

From the results shown in Tables 3-1 to 3-4, it is evident that each of the carriers of Examples had a smaller change in the charge depletion and a smaller change in the volume resistivity, as compared to the carriers of Comparative Examples, and therefore, the carriers of Examples can prevent toner filming and are excellent in durability.

Example 11

In a digital full-color multifunction machine (IMAGIO NEO C600, manufactured by Ricoh Company Ltd.), a developing unit was remolded so as to be equipped with a mechanism for discharging an excessive amount of a developer when the developer being fully supplied. Each toner of four color toners used in IMAGIO NEO C600, i.e. a black toner (IMAGIO Toner Type: 2 Black), a yellow toner (IMAGIO Toner Type: 2 Yellow), a magenta toner (IMAGIO Toner Type: 2 Magenta) or a cyan toner (IMAGIO Toner Type: 2 Cyan) in an amount of 20 parts by mass was mixed with 1 part by mass of the carrier of Example 1 to prepare a supplementary developer.

In the same manner as in the running test for image evaluation described above, a running test of 100,000 sheets was performed with use of an image having an image area of 20%, and a charge amount and a volume resistivity of the carrier were measured at the initial stage of the running test and after the running test. Then, a reduced amount of charge and an amount of change in volume resistivity were calculated. The results are shown in Table 4.

TABLE 4

| | | Ex. 11 |
|---|---|---|
| Black | Amount of charge (Q1) [μC/g] | 40 |
| | Amount of charge (Q2) [μC/g] | 37 |
| | Amount of charge (Q1 − Q2) [μC/g] | 3 |
| Yellow | Amount of charge (Q1) [μC/g] | 40 |
| | Amount of charge (Q2) [μC/g] | 39 |
| | Amount of charge (Q1 − Q2) [μC/g] | 1 |
| Magenta | Amount of charge (Q1) [μC/g] | 40 |
| | Amount of charge (Q2) [μC/g] | 38 |
| | Amount of charge (Q1 − Q2) [μC/g] | 2 |
| Cyan | Amount of charge (Q1) [μC/g] | 40 |
| | Amount of charge (Q2) [μC/g] | 38 |
| | Amount of charge (Q1 − Q2) [μC/g] | 2 |
| Black | Initial volume resistivity [Lgo(Ω · cm)] | 16.2 |
| | Volume resistivity after outputting 100,000 sheets [Lgo(Ω · cm)] | 16.3 |
| | Difference in volume resistivity | −0.1 |
| Yellow | Initial volume resistivity [Lgo(Ω · cm)] | 16.2 |
| | Volume resistivity after outputting 100,000 sheets [Lgo(Ω · cm)] | 16.5 |
| | Difference in volume resistivity | −0.3 |
| Magenta | Initial volume resistivity [Lgo(Ω · cm)] | 16.2 |
| | Volume resistivity after outputting 100,000 sheets [Lgo(Ω · cm)] | 16.4 |
| | Difference in volume resistivity | −0.2 |
| Cyan | Initial volume resistivity [Lgo(Ω · cm)] | 16.2 |
| | Volume resistivity after outputting 100,000 sheets [Lgo(Ω · cm)] | 16.3 |
| | Difference in volume resistivity | −0.1 |

The results shown in Table 4 demonstrated that the use of the supplementary developer made it possible to prevent a decrease in the amount of charge and a change in the volume resistivity.

Industrial Applicability

Since the carrier of the present invention is capable of preventing blocking that could occur when a coating layer is formed on a carrier core material, and is excellent in durability, it can be favorably used in the developer of the present invention and the image forming method of the present invention.

The invention claimed is:

1. A carrier comprising:

core material particles, and a coating layer on surfaces of the core material particles, wherein the coating layer comprises a crosslinked silicone resin having at least one of a silanol group and a functional group capable of generating a silanol group by means of hydrolysis, and at least one organic zirconium catalyst selected from the group consisting of a zirconium chelate and a zirconium acylate.

2. The carrier according to claim 1, wherein the organic zirconium catalyst is a zirconium chelate.

3. The carrier according to claim 1, wherein the amount of the organic zirconium catalyst is 0.5 parts by mass to 20 parts by mass per 100 parts by mass of the silicone resin.

4. The carrier according to claim 2, wherein the organic zirconium catalyst is zirconium tetraacetylacetonate.

5. The carrier according to claim 1, wherein the coating layer further comprises conductive particles.

6. The carrier according to claim 1, wherein the coating layer further comprises a silane coupling agent.

7. The carrier according to claim 1, wherein the coating layer further comprises an acrylic resin.

8. The carrier according to claim 1, wherein the carrier has a volume resistivity of $1\times10^{9}$ Ω·cm to $1\times10^{17}$ Ω·cm.

9. The carrier according to claim 1, wherein the coating layer has an average thickness of 0.05 μm to 4 μm.

10. The carrier according to claim 1, wherein the core material particles have a weight average particle diameter of 20 μm to 65 μm.

11. The carrier according to claim 1, wherein the carrier has a magnetization of 40 $Am^2/kg$ to 90 $Am^2/kg$ in a magnetic field of 1 kOe.

12. An image forming method comprising:

forming a latent electrostatic image on a surface of a latent electrostatic image bearing member, developing the latent electrostatic image using a developer to form a visible image, transferring the visible image onto a recording medium, and fixing the transferred image on the recording medium, wherein the developer comprises a carrier, and a toner, wherein the carrier comprises core material particles, and a coating layer on surfaces of the core material particles, and wherein the coating layer comprises a crosslinked silicone resin having at least one of a silanol group and a functional group capable of generating a silanol group by means of hydrolysis, and at least one organic zirconium catalyst selected from the group consisting of a zirconium chelate and a zirconium acylate.

13. A supplemental developer comprising:

a carrier, and a toner in an amount of 2 parts by mass to 50 parts by mass being mixed with 1 part by mass of the carrier, wherein the carrier comprises core material particles, and a coating layer on surfaces of the core material particles, and wherein the coating layer comprises a crosslinked silicone resin having at least one of a silanol group and a functional group capable of generating a silanol group by means of hydrolysis, and at least one organic zirconium catalyst selected from the group consisting of a zirconium chelate and a zirconium acylate.

* * * * *